US009664204B2

(12) United States Patent
Guemmer

(10) Patent No.: US 9,664,204 B2
(45) Date of Patent: May 30, 2017

(54) ASSEMBLY FOR A FLUID FLOW MACHINE

(71) Applicant: Rolls-Royce Deutschland Ltd & Co KG, Blankenfelde-Mahlow (DE)

(72) Inventor: Volker Guemmer, Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 381 days.

(21) Appl. No.: 14/289,291

(22) Filed: May 28, 2014

(65) Prior Publication Data

US 2014/0356144 A1 Dec. 4, 2014

(30) Foreign Application Priority Data

May 31, 2013 (DE) ..... 10 2013 210 168

(51) Int. Cl.
*F04D 29/54* (2006.01)
*F04D 29/68* (2006.01)
(Continued)

(52) U.S. Cl.
CPC ..... *F04D 29/681* (2013.01); *F04D 29/161* (2013.01); *F04D 29/526* (2013.01); *F04D 29/541* (2013.01); *F04D 29/685* (2013.01)

(58) Field of Classification Search
CPC .... F04D 29/161; F04D 29/526; F04D 29/541; F04D 29/545; F04D 29/547;
(Continued)

(56) References Cited

U.S. PATENT DOCUMENTS 3,011,762 A * 12/1961 Robert Pouit ..... F01D 5/08 415/109
5,431,533 A * 7/1995 Hobbs ..... F01D 5/145 415/145
(Continued)

FOREIGN PATENT DOCUMENTS

DE 69616435 1/1997
DE 19647605 5/1998
(Continued)

OTHER PUBLICATIONS

European Search Report dated Nov. 3, 2014 for counterpart European Patent Application No. 14170060.9.

*Primary Examiner* — Dwayne J White
*Assistant Examiner* — Peter T Hrubiec
(74) *Attorney, Agent, or Firm* — Shuttleworth & Ingersoll, PLC; Timothy Klima

(57) ABSTRACT

A structural assembly for a fluid-flow machine includes a main flow path boundary a row of relatively rotating blades with a gap existing between the blade ends and the main flow path boundary. A secondary flow duct is connected to the main flow path via two openings. A structural assembly has at least one support component and at least one insertion component. A structure extending in the circumferential direction and receiving or holding at least one insertion component along the circumference is provided in the support component. Each insertion component forms with at least some of its faces at least part of the main flow path boundary. Each secondary flow duct is jointly limited along at least part of its course by faces of at least two components of the structural assembly.

26 Claims, 9 Drawing Sheets

(51) Int. Cl.
*F04D 29/52* (2006.01)
*F04D 29/16* (2006.01)

(58) Field of Classification Search
CPC .. F04D 29/681; F04D 29/685; F04D 29/2272; F01D 9/023; F01D 11/04; F01D 11/10; F01D 5/145
See application file for complete search history.

(56) References Cited

U.S. PATENT DOCUMENTS

| | | | | |
|---|---|---|---|---|
| 5,474,417 | A * | 12/1995 | Privett | F04D 29/526 415/173.1 |
| 5,586,859 | A | 12/1996 | Nolcheff | |
| 5,863,178 | A * | 1/1999 | Scheinert | F01D 25/30 415/58.4 |
| 5,950,308 | A * | 9/1999 | Koff | F01D 5/145 29/889 |
| 6,585,479 | B2 | 7/2003 | Torrance | |
| 6,726,441 | B2 | 4/2004 | Sumser et al. | |
| 6,742,983 | B2 | 6/2004 | Schmuecker | |
| 8,152,445 | B2 | 4/2012 | Guemmer | |
| 8,262,340 | B2 | 9/2012 | Guemmer | |
| 8,382,422 | B2 | 2/2013 | Guemmer | |
| 2005/0226717 | A1 | 10/2005 | Xu | |
| 2006/0153673 | A1 * | 7/2006 | Guemmer | F01D 5/145 415/115 |
| 2012/0201654 | A1 * | 8/2012 | Bouru | F04D 27/0207 415/116 |

FOREIGN PATENT DOCUMENTS

| | | |
|---|---|---|
| DE | 10105456 | 8/2002 |
| DE | 10135003 | 10/2002 |
| DE | 10330084 | 3/2004 |
| DE | 102008037154 | 2/2010 |
| EP | 0497574 | 8/1992 |
| EP | 0751280 | 1/1997 |
| EP | 0754864 | 1/1997 |
| EP | 1659293 | 5/2006 |
| EP | 2108784 | 10/2009 |

* cited by examiner

ASSEMBLY FOR A FLUID FLOW MACHINE

BACKGROUND

This application claims priority to German Patent Application No. 10 2013 210 168.6 filed on May 31, 2013, the entirety of which is incorporated by reference herein.

This invention relates to a structural assembly for a fluid-flow machine.

The aerodynamic loadability and the efficiency of fluid-flow machines, in particular of fluid-flow machines such as blowers, compressors, pumps and fans, is limited by the growth and the separation of boundary layers in the rotor and stator blade tip area near the casing or the hub wall, respectively. On blade rows with running gap, this leads to high secondary losses and possibly to the occurrence of operational instabilities at higher loads.

A known counter-measure is to use so-called casing treatments. The simplest form of casing treatments are circumferential grooves having rectangular or parallelogram-shaped cross-sections, as disclosed for example in EP 0 754 864 A1. Other solutions provide for rows of slots or openings in the casing, with the individual slots/openings being oriented substantially in the flow direction and having a slender form with a small extent when viewed in the circumferential direction of the machine. Solutions of this kind are disclosed for example in DE 101 35 003 C1.

Further casing treatments include provision of a ring over the entire circumference in the area of a rotor in the casing, with stator vanes often being provided to reduce the flow swirl inside the treated casing, as for example described in the publications EP 0 497 574 A1, US 2005-0226717 A1, U.S. Pat. No. 6,585,479 B2, US 2005-0226717 A1 and DE 103 30 084 A1.

Existing concepts for casing treatments in the form of slots and/or chambers in the annular duct wall offer increased stability of the fluid-flow machine. This is however only achieved with a loss in efficiency due to the unfavourably selected arrangement or shape. Known solutions also take up a large installation space at the periphery of the annular duct of the fluid-flow machine, and due to their shape (e.g. simple parallelogram-shaped circumferential casing grooves) they are only of restricted effectiveness and are always provided in the casing in the area of a rotor blade row. Casing treatments according to the state of the art are intended for easy implementation in the casing from an accessible side with the aid of machining, usually metal-cutting.

The use of injector systems is known as a further counter-measure against secondary losses and the occurrence of operational instabilities. For example, it is known from U.S. Pat. No. 8,152,445 B2, to pass fluid from a fluid supply chamber into the flow duct by means of a nozzle system. FIG. 1 shows the solution described in U.S. Pat. No. 8,152,445 B2. A disadvantage of this solution is that a complex secondary flow duct system for fluid injection in the area of the casing or hub must be provided by specific design and production measures.

A fluid-flow machine is known from DE 10 2008 037 154 A1, which has, in the area of the blade leading edge in a main flow path boundary, at least one secondary flow duct connecting to one another two openings arranged on the main flow path boundary. Each secondary flow duct connects one discharge opening to a supply opening provided further upstream. The provision of secondary flow ducts of this type permits effective influencing of the boundary layer in the blade tip area and hence allows an increase in the stability of a fluid-flow machine, without the need for an expensive casing treatment over the entire casing circumference in the area of a rotor. However, complex secondary flow ducts in the area of the casing or hub can only be achieved by specific design and production measures.

SUMMARY

Based on DE 10 2008 037 154 A1, an object underlying the present invention is to provide a structural assembly that can efficiently provide secondary flow ducts, even those of complex shape, in the area of a main flow path boundary of a fluid-flow machine (i.e. in the area of the casing or hub). The intention is to provide a spatially compact and sturdy structural design.

It is provided in accordance with an embodiment of the invention that the structural assembly has at least one support component and at least one insertion component. A structure extending in the circumferential direction and receiving or holding at least one insertion component along the circumference is provided in the support component. Each insertion component forms with at least some of its faces at least part of the main flow path boundary. It is furthermore provided in accordance with the invention that each secondary flow duct is jointly limited along at least part of its course by faces of at least two components of the structural assembly, such that in the assembled state each of the secondary flow ducts is completely surrounded by said faces.

The solution in accordance with the invention is thus based on the idea of providing secondary flow ducts which at least along one part-section are jointly formed by the faces of several components of the structural assembly, i.e. the secondary flow ducts are provided at least in some sections at the boundary surfaces between adjacent components of the structural assembly, for example by surface structuring of at least one of these boundary surfaces.

The invention thus considers a section of the main flow path of a fluid-flow machine, in the area of a blade row with free end and running gap, in which a row of secondary flow ducts distributed in the circumferential direction is provided. The course of the secondary flow ducts can be spatially complex in each case. In accordance with the invention, a structural assembly is provided for structural implementation of said secondary flow ducts.

An embodiment of the invention provides that at least one secondary flow duct is formed along at least part of its course by faces of a support component and of an insertion component.

According to an embodiment of the invention, the structural assembly can additionally have at least one auxiliary component that likewise provides faces limiting a secondary flow duct along at least part of its course. It can be provided here that at least one auxiliary component is arranged in the axial direction in front of or behind an insertion component and forms together with faces of the insertion component a section of the secondary flow duct. In particular, two auxiliary components can be arranged in the axial direction in front of and behind the insertion component and form two sections of the secondary flow duct.

An embodiment of the invention provides that the structure extending in the circumferential direction and receiving or holding an insertion component is a recess, a projection or a web. For example, the insertion component is inserted into a recess of the support component in the radial direction or pushed in the axial direction, or fastened to a projection or web of the support component or slid onto the same.

In embodiments of the invention, the support component is designed as an annular casing or as a half-shell casing of a fluid-flow machine and encloses this at least one further component of the structural assembly from the outside. It can also be provided that the support component is designed annular or semi-annular on the hub of a fluid-flow machine and braces at least one further component of the structural assembly from the inside. The at least one insertion component and/or the at least one auxiliary component of the assembly can be designed as a complete ring or as a ring sector. Both the support component and the insertion component can also be designed as annular casings.

According to an embodiment of the invention, the at least one secondary flow duct is provided predominantly in the insertion component, for example by ducts or longitudinal grooves provided on a convex outer face of the insertion component, where the support component completes the secondary flow duct by at least one of its faces. In this connection, it can be provided that the face of the support component limiting the secondary flow duct is designed as part of a plane, a cone, a circular cylinder or a cylinder, and in this way the sections of the at least one secondary flow duct in the insertion component that are still open are closed flush.

According to a further embodiment of the invention, the secondary flow duct is predominantly provided in the support component, for example by ducts or longitudinal grooves provided on a concave outer face of the support component, with the insertion component completing the secondary flow duct by at least one of its faces. To do so, it can be provided that the faces of the insertion component limiting the secondary flow duct are designed as part of a plane, a cone, a circular cylinder or a cylinder, and in this way the sections of the at least one secondary flow duct in the support component that are still open are closed flush.

According to a further variant of the invention, the insertion component is in the meridional view surrounded predominantly by the support component on its sides not facing the main flow path.

The insertion component is in respect of its shape and surface finish designed in an embodiment of the invention such that it can be inserted into the support component in the axial direction of the fluid-flow machine. This permits easy assembly. For positioning and connecting the support component and the insertion component it can be provided that the support component and the insertion component are connected by a common flange. It can also be provided that the support component forms an annular projection onto which the insertion component is slid in the axial direction.

An embodiment of the invention provides that the splitting of the wetted surfaces of the secondary flow duct between the support component and the insertion component is selected such that a central section of the secondary flow duct, which when seen in the meridional view runs substantially along the direction of the main flow path boundary, is provided in the support component and covered by a surface of the insertion component, while at least one section of the secondary flow duct provided on the main flow path boundary in the area of the openings is provided with all wetted faces completely inside the insertion component.

A further embodiment of the invention provides that a replaceable plug is provided that passes through the support component and/or the insertion component from the side facing away from the main flow path, where the plug contains a section of a secondary flow duct such that it connects to the remaining section of the secondary flow duct not extending inside the plug. It can be provided here that the top face of the replaceable plug forms part of the main flow path boundary and that one of the openings of the secondary flow duct is provided in said top face. The plug is inserted in the radial direction and ends with its front face at the main flow path boundary.

A further embodiment of the invention provides that a central section of the secondary flow duct, which when seen in the meridional view runs substantially along the direction of the main flow path boundary, is provided individually or jointly in the support component and/or the insertion component. Furthermore, at least one section of the secondary flow duct, which is formed by a combination of faces of the insertion component and faces of at least one auxiliary component, is provided on the main flow path boundary in the area of the openings, i.e. in the areas close to the openings. The support component and the insertion component therefore provide according to this design variant only one section of the secondary flow duct. Other sections are formed by means of at least one auxiliary component. It can be provided here that the faces of the insertion component and the faces of the at least one auxiliary component have a locally heavily curved course and hence form in this area a heavily curved secondary flow duct.

A further embodiment of the invention provides that an insertion component and at least one auxiliary component are brought into contact with one another substantially along the direction of the main flow path boundary. It can be provided here that an insertion component is brought into contact with two auxiliary components substantially along the direction of the main flow path boundary and is arranged substantially between the auxiliary components. It can further be provided that at least one of the auxiliary components can be inserted in the axial direction together with the insertion component into the support component.

A further embodiment of the invention provides that an auxiliary component has on the sides facing the insertion component a contour profile which is constant in the circumferential direction of the fluid-flow machine, with said contour profile providing both a part-boundary face of at least one secondary flow duct and contact faces to the insertion component. It can also be provided that an auxiliary component has on its sides facing the insertion component a contoured shape in the circumferential direction of the fluid-flow machine, said contoured shape creating a part-boundary face of at least one secondary flow duct and contact faces to the insertion component.

A further embodiment of the invention provides that an auxiliary component and an insertion component engage into one another and/or that an auxiliary component and an insertion component are interlocked along the circumference and/or that the auxiliary component has locally on the circumference at least one projection engaging in the insertion component and forming the part-boundary face of at least one secondary flow duct.

A further embodiment of the invention provides that when viewing a secondary flow duct section in the area of the openings on the main flow path boundary in the meridional view, one line with continuously convex curvature and one line with continuously concave curvature exist along the inner contour of the secondary flow duct, said lines being substantially opposite each other inside a secondary flow duct section. It can be provided here that at least one section of the convex line is associated with the insertion component and at least one section of the concave line with an auxiliary component.

A further embodiment of the invention provides that an auxiliary component and an insertion component are designed as at least part of a ring and in the assembled state engage with projections and recesses alternatingly provided on the circumference.

The insertion component is for example manufactured by a casting, sintering or printing production method.

The present invention generally relates to structural assemblies for fluid-flow machines, such as turbines, and in particular to fluid-flow machines such as blowers, compressors, pumps and fans of the axial, semi-axial and radial type. The working medium may be gaseous or liquid. The fluid-flow machine may include one or several stages, each having a rotor and a stator. In individual cases, the stage is formed only by a rotor.

The rotor of a fluid-flow machine, in which a structural assembly in accordance with the present invention is used, includes a number of blades, which are connected to the rotating shaft of the fluid-flow machine and impart energy to the working medium. The rotor may be provided with or without shroud at the outer blade end.

The stator of a fluid-flow machine, in which a structural assembly in accordance with the present invention is used, includes a number of stationary vanes, which may have a fixed or a free vane end both on the hub and on the casing side.

The rotor drum and the blading are usually enclosed by a casing. In other cases, e.g. in the case of aircraft or ship propellers, no such casing exists.

A fluid-flow machine, in which a structural assembly in accordance with the present invention is used, may also feature a stator, a so-called inlet guide vane assembly, upstream of the first rotor. Departing from a stationary fixation, at least one stator or inlet guide vane assembly may be rotatably borne, to change the angle of attack. Variation is accomplished for example via a spindle accessible from the outside of the annular duct.

In an embodiment, a fluid-flow machine, in which a structural assembly in accordance with the present invention is used, may include at least one row of variable rotors.

In an embodiment, a fluid-flow machine, in which a structural assembly in accordance with the present invention is used, may have two counter-rotating shafts, in the event of a multi-stage design, with the direction of rotation of the rotor blade rows alternating between stages. Here, no stators exist between subsequent rotors.

In an embodiment, a fluid-flow machine, in which a structural assembly in accordance with the present invention is used, may feature a bypass configuration such that a single-flow annular duct divides into two concentric annular ducts behind a certain blade row, with each of these annular ducts containing at least one further blade row.

The fluid-flow machine, in which a structural assembly in accordance with the present invention is used, is for example a jet engine, in particular a turbofan engine. The structural assembly is for example provided in the area of a compressor of a jet engine or turbofan engine.

The present invention furthermore relates to a fluid-flow machine having a structural assembly in accordance with the present invention.

BRIEF DESCRIPTION OF THE DRAWINGS

The present invention is described in the following with reference to the figures of the accompanying drawing, showing several exemplary embodiments.

DETAILED DESCRIPTION

Figure 1:
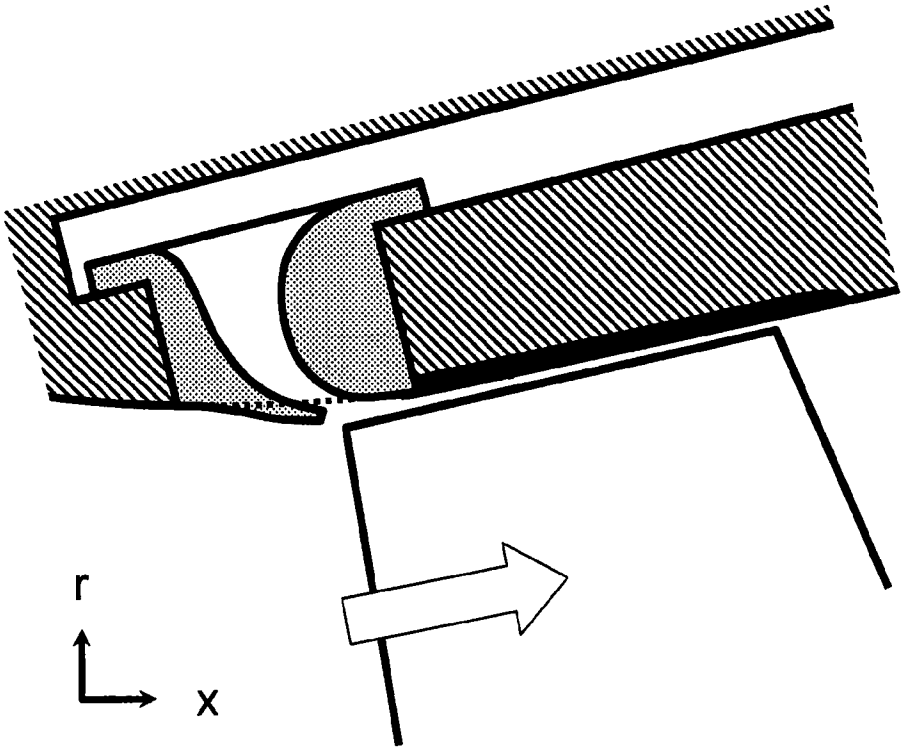
FIG. 1 shows a rotor casing with an integrated nozzle for injecting fluid into a running gap in accordance with the state of the art.

The teachings in accordance with the state of the art for injection of fluid from a fluid supply chamber into a flow duct by means of a nozzle system were described at the outset on the basis of FIG. 1.

Figure 2A:
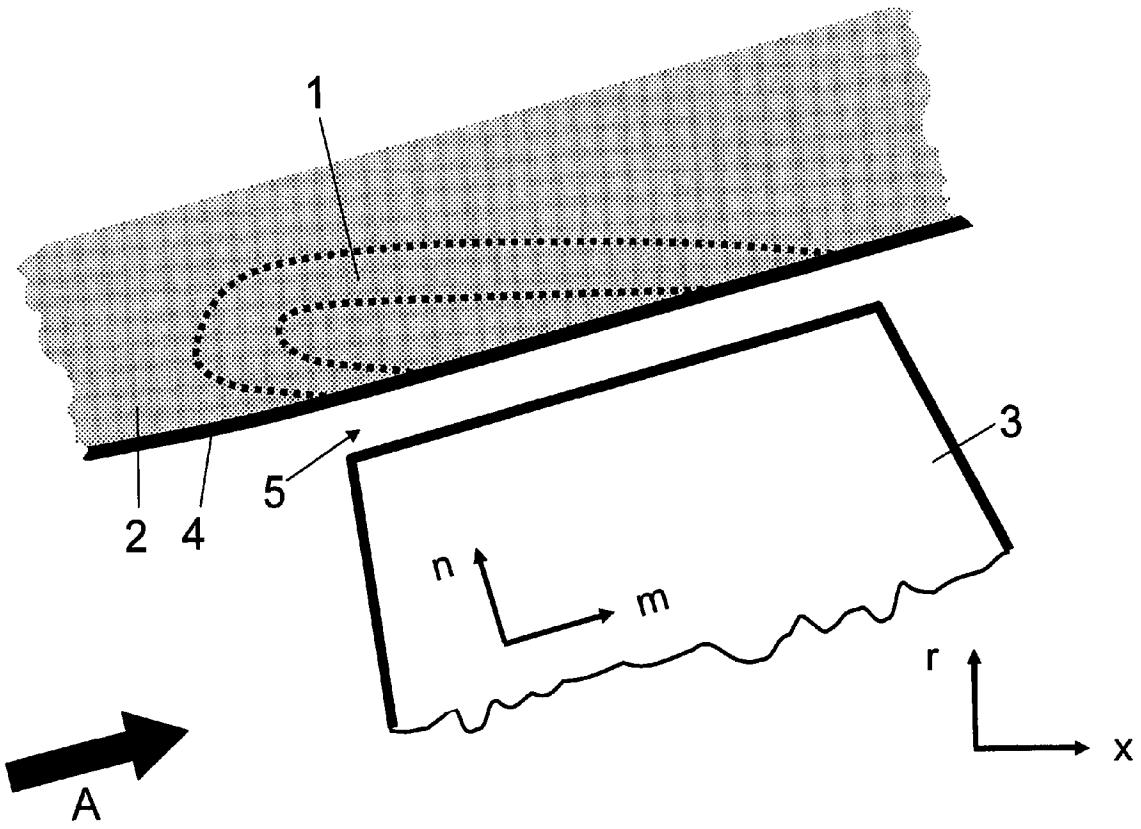
FIG. 2A shows, in meridional sectional view, an exemplary embodiment of a rotor casing of a fluid-flow machine having a secondary flow duct.

FIG. 2A shows an arrangement of a blade row 3 with free end and running gap 5 in the meridional plane established by the axial direction x and the radial direction r. The running gap 5 separates the blade tip from a component 2 associated with the main flow path on the hub or casing of the fluid-flow machine. The component 2 forms here a main flow path boundary 4 towards the main flow path.

There is a rotating relative movement between the blade tip and the component 2 associated with the main flow path. The illustration thus applies equally for the following arrangements:

1) rotating blade on stationary casing,
2) stationary blade on rotating hub,
3) stationary blade on rotating casing, and
4) rotating blade on stationary hub.

The main flow direction in the main flow path is indicated by an arrow A. Further blade rows can be located upstream and/or downstream of the blade row 3 with running gap. Inside the component 2 associated with the main flow path, a row of secondary flow ducts 1 distributed over the circumference is provided in the area of the running gap 5, said ducts having an opening at each of their ends (supply opening and discharge opening).

The openings of the secondary flow ducts are located on the main flow path boundary 4. FIG. 2A shows the outline or projection of a single secondary flow duct 1 in the meridional plane (x-r). Viewed spatially, each duct 1 has a three-dimensional and spatially winding course, shown by way of example in FIG. 2B.

Figure 2B:
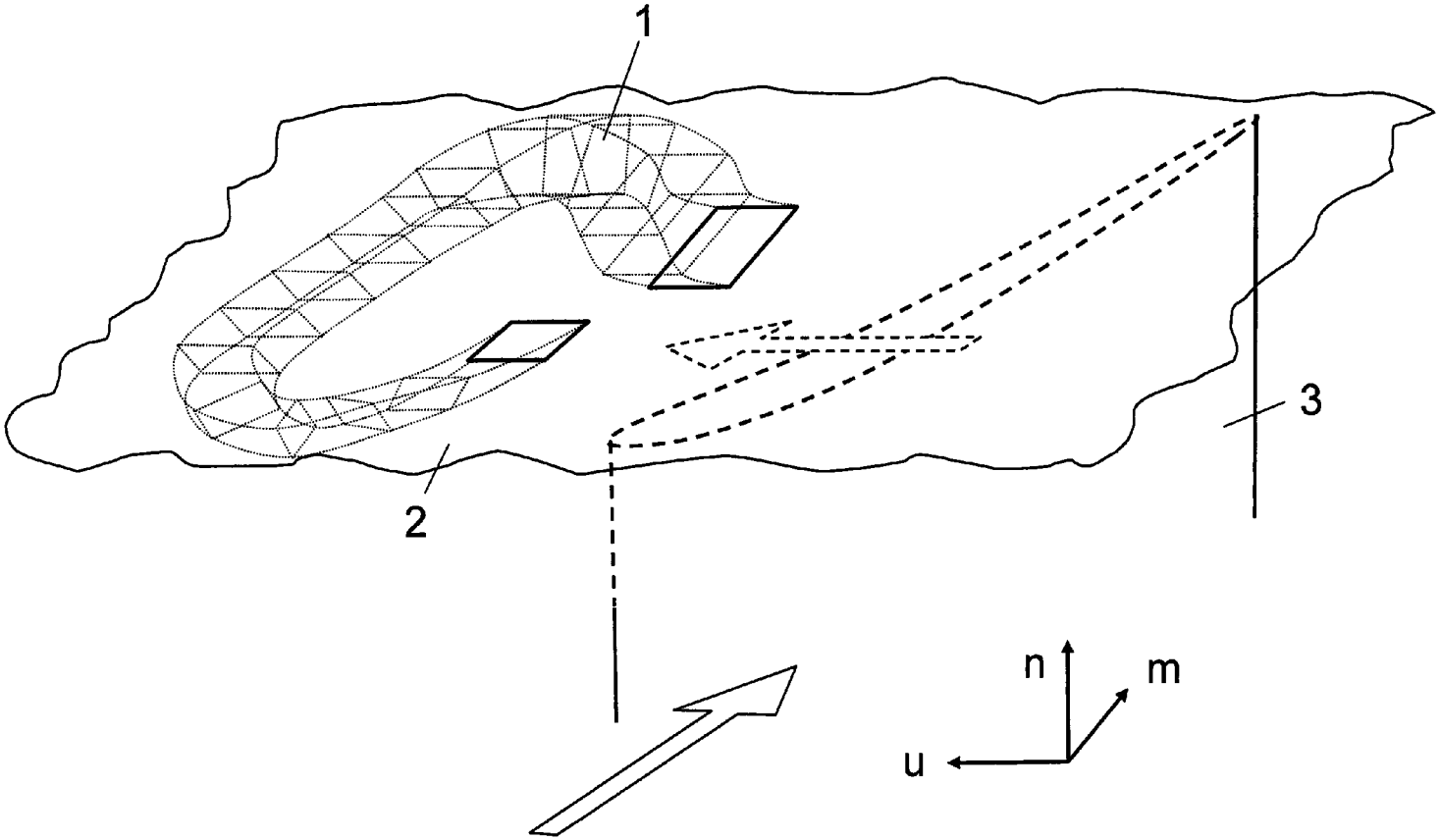
FIG. 2B shows, in a three-dimensional view, an exemplary embodiment of a rotor casing of a fluid-flow machine having a secondary flow duct.

It is pointed out that the cross-sectional shape of the secondary flow ducts 1 in FIG. 2B is illustrated as rectangular only by way of example. The cross-section of the secondary flow ducts 1 in other design variants can for example be designed without corners, in particular circular or elliptical.

Figure 3A:
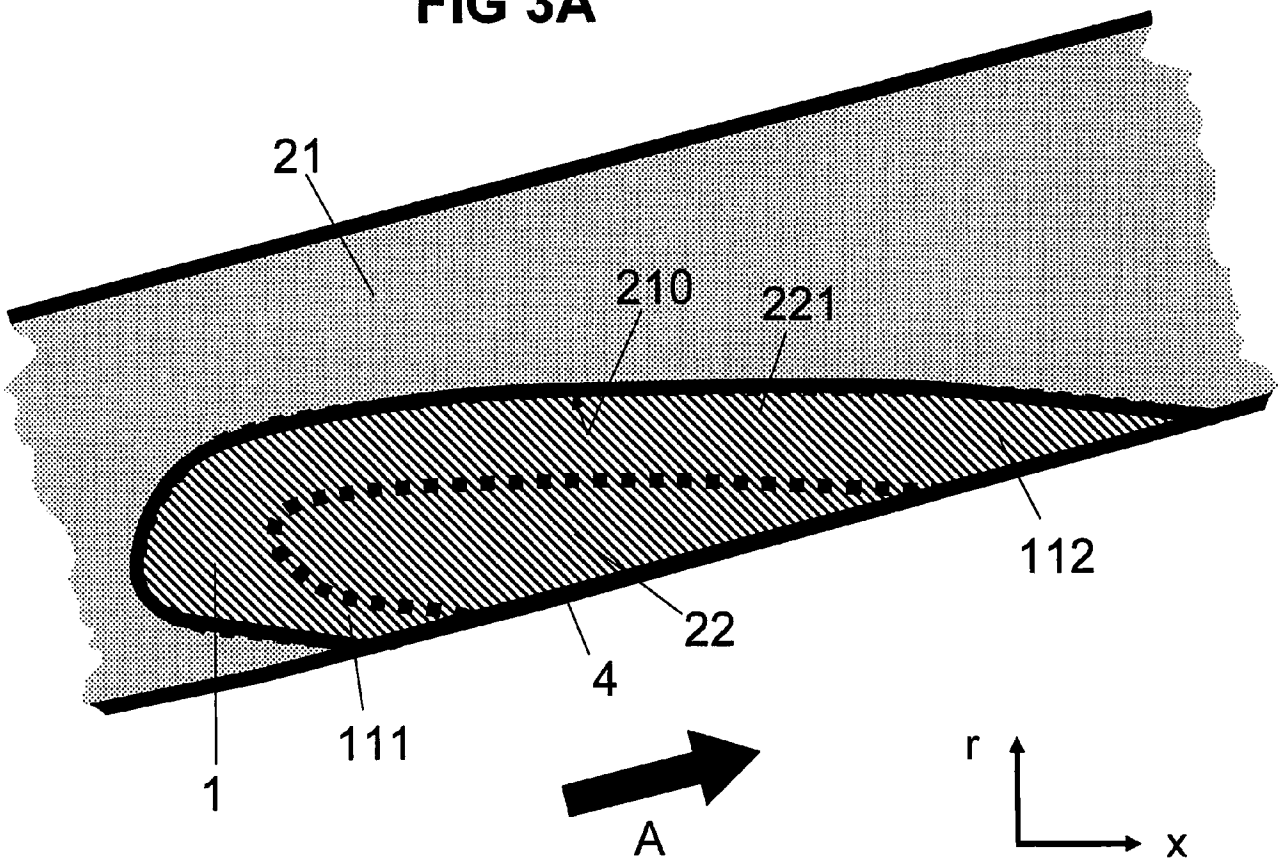
FIG. 3A shows a first exemplary embodiment of a structural assembly for a fluid-flow machine forming a secondary flow duct.

FIG. 3A shows a structural assembly in accordance with the present invention in the area of a blade row with running gap in the meridional view (x-r). The main flow direction is indicated by an arrow A. The blade row is no longer shown here for the sake of a simpler illustration.

In the structural assembly, at least one secondary flow duct 1 is provided which has two openings 111, 112 in the main flow path boundary 4 and is connected via these openings to the main flow path. It is pointed out here that in the exemplary embodiment of FIG. 3A the secondary flow duct 1 is designed as a one-way path, having one opening through which fluid flows out of the main flow duct into the secondary flow duct 1 and a second opening through which fluid exits the secondary flow duct 1. Through which of the openings 111, 112 fluid flows in, and through which of the openings 111, 112 fluid flows out, depends here on the precise positioning of the openings 111, 112 relative to the blades of the blade row 3 (cf. FIG. 2B).

In alternative embodiments, it can be provided that at least one of the secondary flow ducts is formed by an arrangement in which a single duct splits along its course into at least two part-ducts and thereby forms a type of Y-configuration. In this case, an inflow opening and several outflow openings associated with the secondary flow duct are provided. According to a further alternative embodiment, it can be provided that at least one of the secondary flow ducts is formed by an arrangement in which at least two ducts converge into one duct, with several inflow openings and one outflow opening then being associated with the secondary flow duct.

According to FIG. 3A, the secondary flow duct 1 is achieved using two components connected to one another, a support component 21 and an insertion component 22.

The support component 21 is used for structural implementation in the area of the inner or outer main flow path boundary and can be part of the outward casing or of the inward hub of the fluid-flow machine. It can be provided that it forms with some of its faces part of the main flow path boundary 4. In the exemplary embodiment shown, the support component 21 represents a part of the outward casing of the fluid-flow machine. In principle, the support component 21 can in particular be a part of the fluid-flow machine design in the following areas:

- part of a single-shell or multi-shell casing of blade rows or stages with fixed blade geometry,
- part of a single-shell or multi-shell casing of blade rows or stages with variable blade geometry,
- part of rotor drums, rotor disks or blisk modules,
- part of inner shroud assemblies in the hub area of stator vanes.

In the exemplary embodiment of FIG. 3A, the support component is designed as an annular casing of a fluid-flow machine or as a half-shell casing of a fluid-flow machine. With an appropriate arrangement in the hub area, it is for example designed annular on the hub of a fluid-flow machine or semi-annular on the hub of a fluid-flow machine.

The support component 21 has a concave structure in the circumferential direction, which in the exemplary embodiment under consideration is designed as a recess and forms an outer face 210. The insertion component 22 having a convex shape is inserted into the recess along the circumference of the support component 21. It is provided here that the insertion component 22 forms with some of its faces part of the main flow path boundary 4.

The secondary flow duct 1 is limited along its course on the one hand by faces of the support component 21 and on the other hand by faces of the insertion component 22, which together, i.e. in the assembled state, completely surround the secondary flow duct 1. In the exemplary embodiment shown of FIG. 3A, the insertion component 22 forms recesses in the shape of ducts 221 which are for example designed as grooves or the like on the outside of the insertion component 22. These ducts 221 are closed by the outer face 210 of the support component 21, so that overall completely closed secondary flow ducts 1 are created. The secondary flow ducts 1 are only opened via the openings 111, 112 to the main flow duct.

The faces of the secondary flow ducts 1 wetted by flowing fluid are thus jointly formed by faces of different components of the structural assembly, in the exemplary embodiment of FIG. 3A by faces of the support component 21 and by faces of the insertion component 22. The insertion component 22 is here completely inserted into a recess of the support component 21.

Figure 3B:
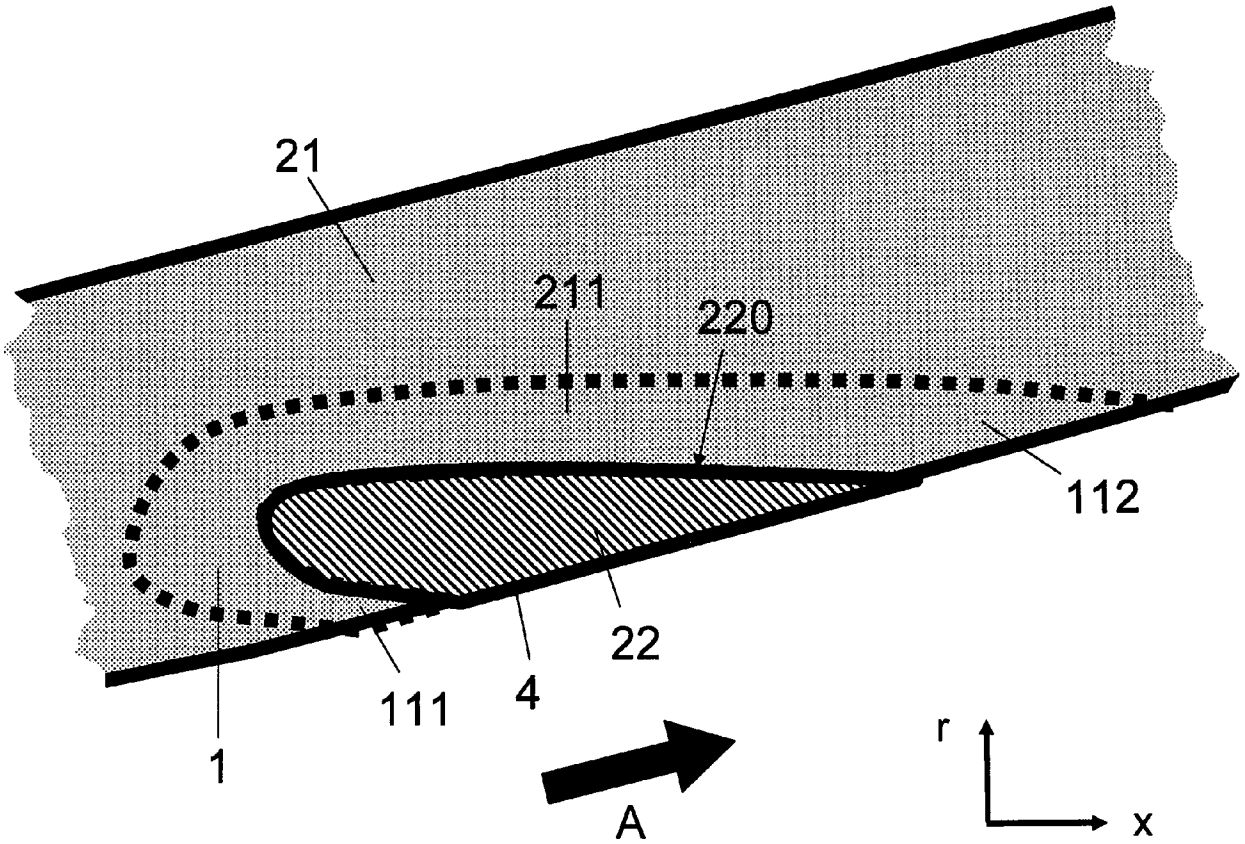
FIG. 3B shows a second exemplary embodiment of a structural assembly for a fluid-flow machine forming a secondary flow duct.

FIG. 3B shows a further exemplary embodiment of a structural assembly in the area of a blade row with running gap in the meridional view (x-r). The exemplary embodiment of FIG. 3B differs from the exemplary embodiment of FIG. 2A in that the grooves or ducts forming a secondary flow duct 1 are provided not in the insertion component 22, but in the support component 21. Accordingly, the support component includes grooves or ducts 211 which structure the outer face of the support component 21 in the area under consideration. An appropriate structuring of the support component 21 for the provision of grooves or ducts 211 can be achieved for example by milling or similar methods. The grooves or ducts 211 are closed by a substantially closed outer face 220 of the convex insertion component 22.

While external grooves or the like for forming the secondary flow ducts 1 are provided in the insertion component 22 in FIG. 3A, they are provided in the support component 21 in FIG. 3B. In all other respects the exemplary embodiments of FIGS. 3A and 3B match one another.

Figure 3C:
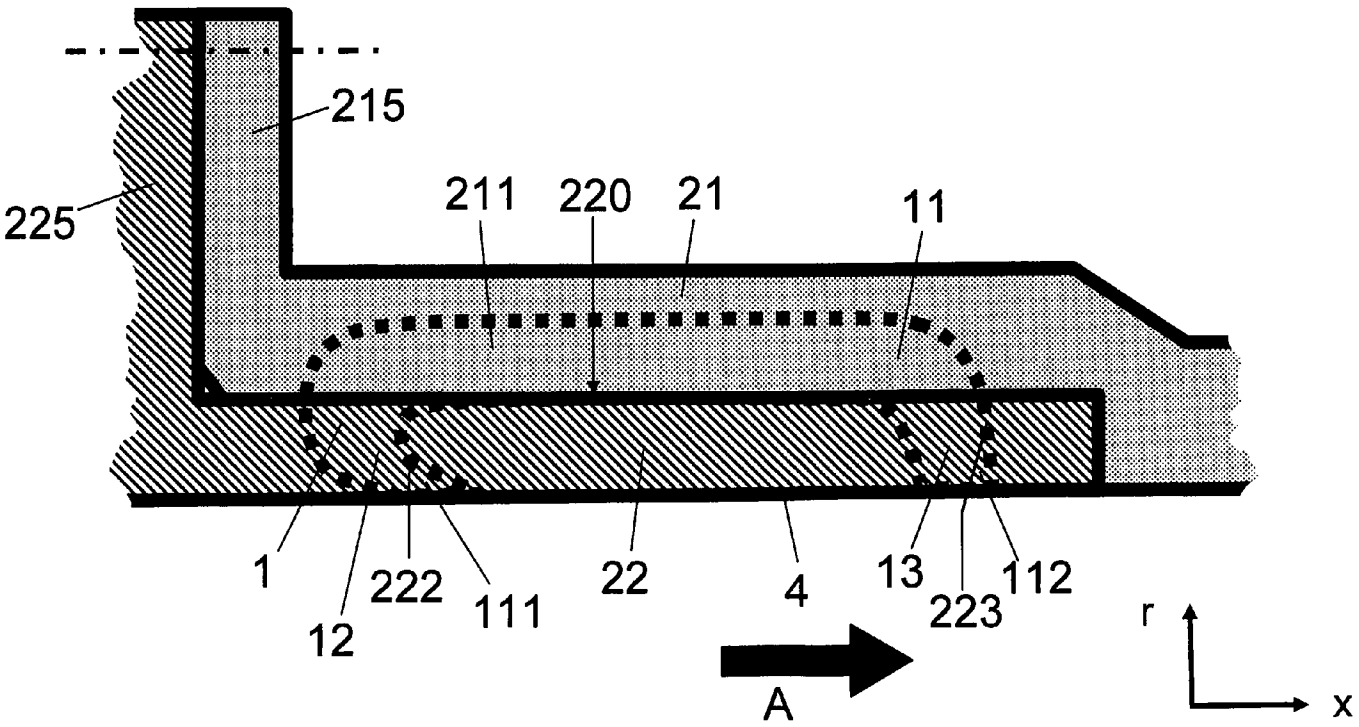
FIG. 3C shows a third exemplary embodiment of a structural assembly for a fluid-flow machine forming a secondary flow duct.

FIG. 3C shows a further exemplary embodiment of a structural assembly in the area of a blade row with running gap in the meridional view (x-r). In the exemplary embodiment of FIG. 3C, the insertion component 22 and the support component 21 form two annular or partially annular casings which are slid one above the other in the axial direction and adjoin one another in the radial direction when in the assembled state, with the insertion component 22 being surrounded on its side not facing the main flow path by the support component 21. This design variant has the advantage that the insertion component 22 is relatively easy to assemble in that it is slid in the axial direction of the fluid-flow machine into the support component 21.

A flange section 215 of the support component 21, on which a flange section 225 of the insertion component 22 is positioned and fastened, for example, is used here for axial positioning. It is in turn provided that the insertion component 22 forms with some of its outer faces part of the main flow path boundary 4.

The secondary flow duct 1 includes three sections: a central section 11, which as in the exemplary embodiment in FIG. 3B is formed by grooves or ducts 211 in the support component 21, and two sections 12, 13, which discharge into the openings 111, 112 respectively of the secondary flow duct 1 to the main flow path and which are designed as passages or openings 222, 223 in the insertion component 22.

In this exemplary embodiment, the secondary flow duct 1 is therefore limited only along a part of its course, i.e. in its central section 11, jointly by faces of two components of the structural assembly, i.e. by faces 211 of the support component 21 and by the face 220 of the insertion component 22.

The other sections 12, 13 of the secondary flow duct 1 are provided solely inside the insertion component 22.

In the exemplary embodiment of FIG. 3C, the situation is therefore such that a split of the wetted surfaces of the secondary flow duct 1 between the support component 21 and the insertion component 22 is selected in a way that the central section 11 of the secondary flow duct 1, which when seen in the meridional view (x-r) runs substantially along the direction of the main flow path boundary, is provided in the support component 21 and is covered with a surface 220 of the insertion component 22, while the sections of the secondary flow duct 1 in the area of the openings 111, 112 on the main flow path boundary 4 are completely provided by all the wetted faces in the insertion component 22.

Figure 3D:
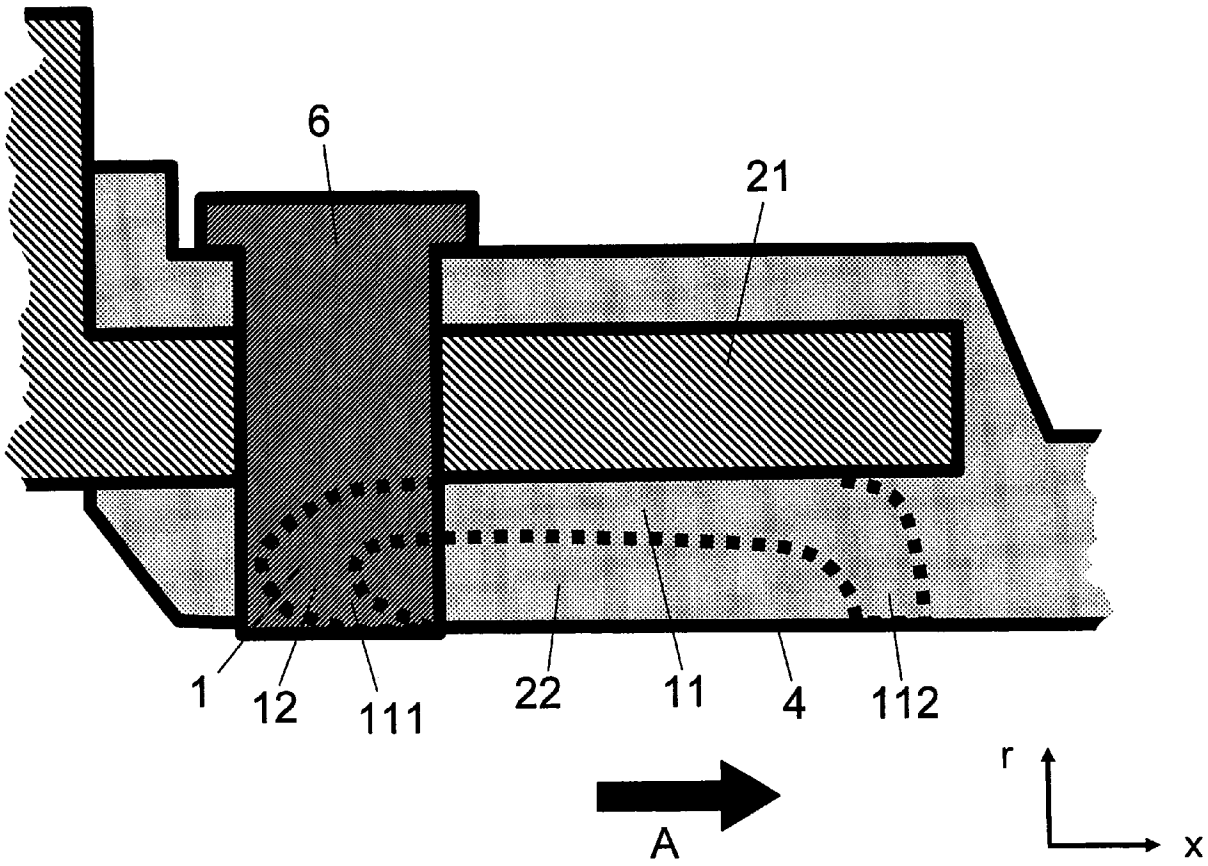
FIG. 3D shows a fourth exemplary embodiment of a structural assembly for a fluid-flow machine forming a secondary flow duct.

FIG. 3D shows a further exemplary embodiment of a structural assembly in the area of a blade row with running gap in the meridional view (x-r). The structural assembly includes in turn a support component 21 and an insertion component 22, with the support component 21 being designed as an annular projection onto which the insertion component 22 is fitted in the axial direction, i.e. against the flow direction. The insertion component 22 here adjoins the support component 21 in the radial direction on the inside and on the outside.

The structural assembly furthermore includes a replaceable plug 6 which passes through at least one of the two components—support component 21 and insertion component 22—from the side facing away from the main flow path. In the present exemplary embodiment, both the support component 21 and the insertion component 22 are passed through by the plug 6 in the radial direction. It is furthermore provided that the replaceable plug 6 contains a section 12 of the secondary flow duct 1, such that it connects to a section 11 of the secondary flow duct 1 not running inside the plug 6, with the top face of the replaceable plug 6 forming part of the main flow path boundary 4 and one of the openings 111 of the secondary flow duct 1 being provided in the top face.

The secondary flow duct 1 thus includes two sections 11, 12, where one section 11 is jointly limited by faces of two components of the structural assembly, i.e. the support component 21 and the insertion component 22, and where a further section 22 is provided completely inside the plug 6.

The plug 6 is preferably designed non-elastic. It is for example bolted into the support component 21 and/or the insertion component 22.

The design variant of FIG. 3D has the advantage that the reverse flow mechanism provided by the secondary flow duct 1 can be interrupted or switched on and off by replacing the plug 6. This also permits, in the case of wear in the area 12 of the secondary flow duct 1, renewal of this area 12 by replacing the plug 6.

Figure 3E:
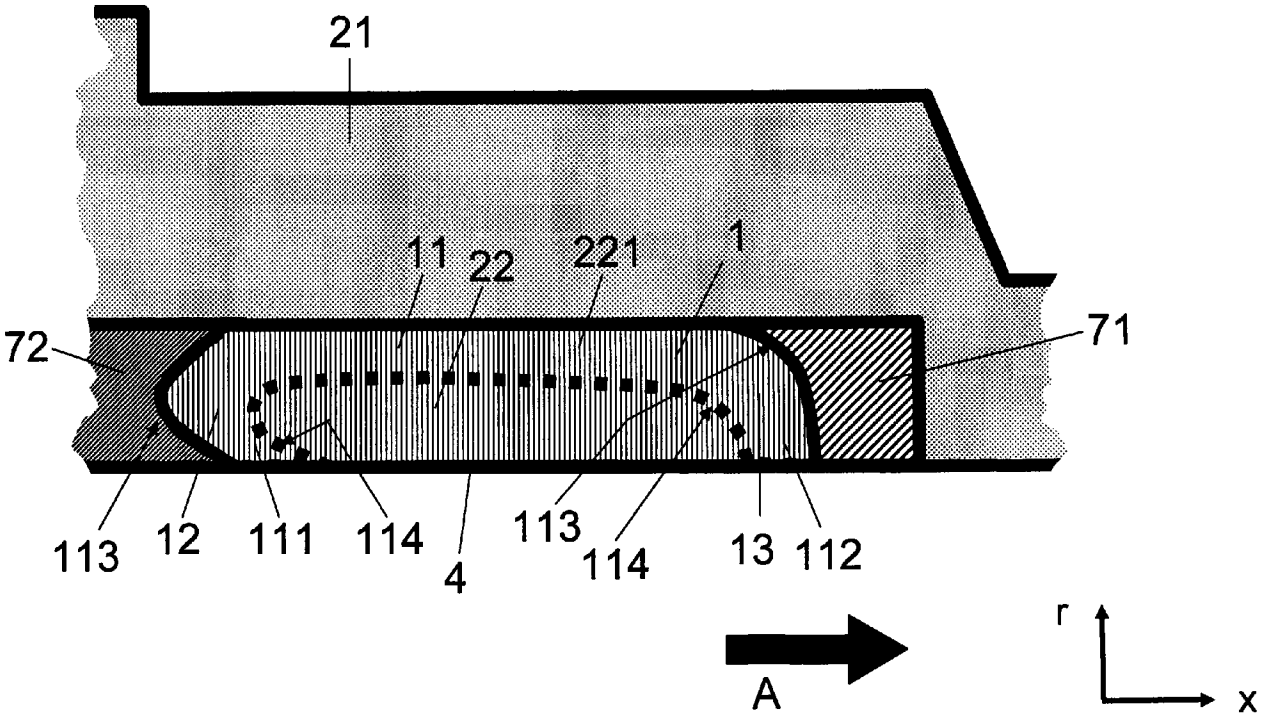
FIG. 3E shows a fifth exemplary embodiment of a structural assembly for a fluid-flow machine forming a secondary flow duct.

FIG. 3E shows a further exemplary embodiment of a structural assembly in the area of a blade row with running gap in the meridional view (x-r). Initially, the exemplary embodiment of FIG. 3E is similar to the exemplary embodiment of FIG. 3A to the extent that a central section 11 of the secondary flow duct 1 is provided which is formed by ducts or external grooves 221 in an insertion component 22 which is inserted into a recess of a support component 21, where the outer face of the support component closes said ducts or external grooves 221, respectively. In the central section 11, the secondary flow duct 1 is thus formed by faces of two components of the structural assembly, i.e. by faces of the support component 21 and by faces of the insertion component 22.

Unlike in the exemplary embodiment of FIG. 3A, the secondary flow duct 1 includes two further sections 12, 13 in which the secondary flow duct 1 is likewise limited by faces of two components of the structural assembly, with however two additional components, i.e. two auxiliary components 71, 72, being provided which are arranged in the axial direction in front of and behind the insertion component 22 for limitation. The insertion component 22 and the two auxiliary components 71, 72 form to that extent a structural sub-assembly which is inserted into a recess extending in the circumferential direction inside the support component 21, for example in the axial direction.

It can be provided as shown that the sections 12, 13 formed by faces of the insertion component 22 and of an auxiliary component 71, 72, and each discharging into one of the openings 111, 112 of the secondary flow duct 1, have a heavily curved course. Here the auxiliary components 71, 72 have in the exemplary embodiment shown, however not necessarily, a continuously concave curvature 113 and the corresponding faces of the insertion component 22 have a continuously convex curvature 114, for achieving the inner contour of the secondary flow duct 1 in the area of the sections 12, 13, i.e. in the area close to the opening. The corresponding concave and convex faces 113, 114 are substantially opposite each other.

It is pointed out that instead of two auxiliary components, as shown in FIG. 3E, it is also possible to provide only one auxiliary component or a larger number of auxiliary components in alternative exemplary embodiments.

FIG. 3E thus shows an exemplary embodiment in which the outer contours of the secondary flow duct 1 in the area close to the opening are provided by the insertion component 22 and by auxiliary components 71, 72, which are also part of the structural assembly.

Figure 3F:
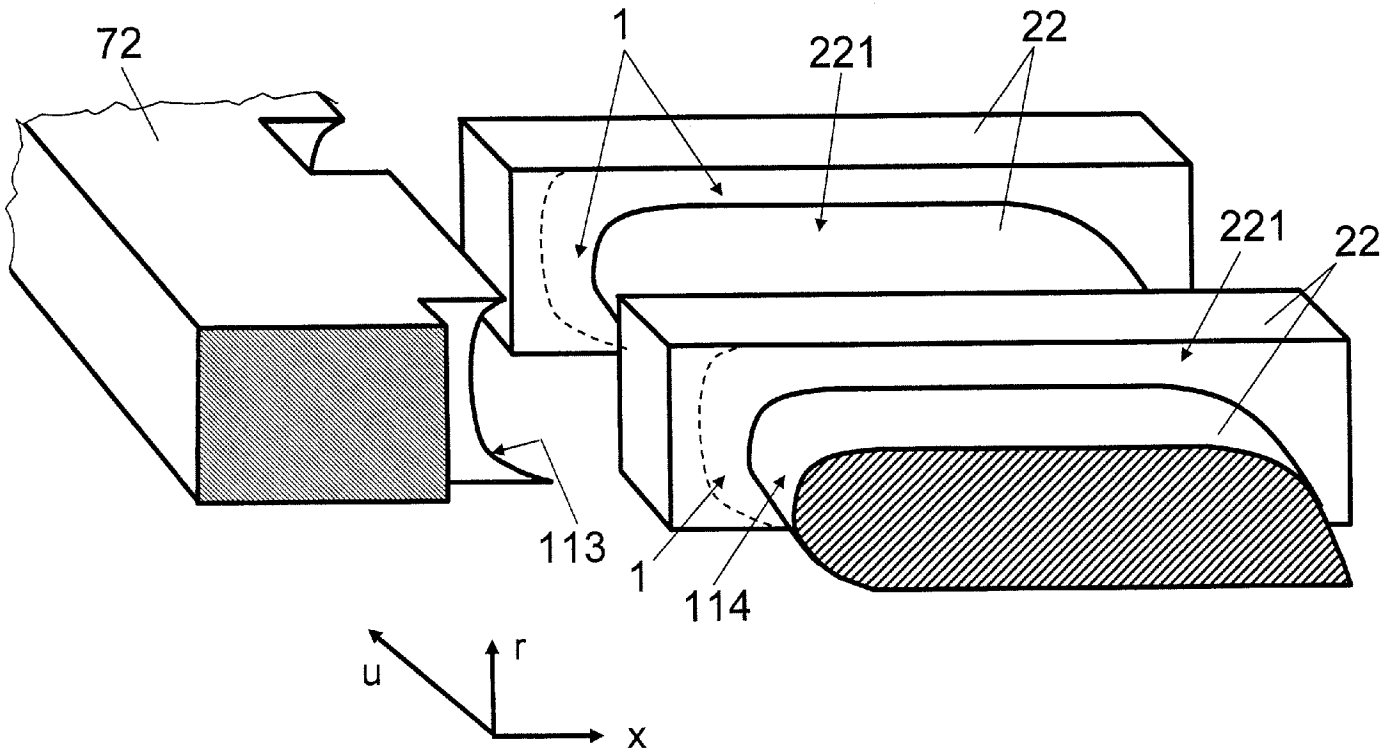
FIG. 3F shows, in perspective view, some of the support components of the exemplary embodiment of FIG. 3E.

FIG. 3F shows in a perspective view the one auxiliary component 72 and the insertion component 22 of FIG. 3E, without the further components 21, 71 of FIG. 3E being shown too. The circumferential direction u is also shown, and it can be discerned that the insertion component 22 like the auxiliary component 72 (and of course also the support component, not shown) extend in the circumferential direction, either over part of the circumference of the main flow path boundary or over the entire circumference of the main flow path boundary, where the structures repeat themselves to form a secondary flow duct 1 along the circumference.

FIG. 3F shows the recesses 221 in the insertion component 22, which form some of the faces of the secondary flow duct 1. Also, the faces with continuously concave curvature 113 and with continuously convex curvature 114 on the auxiliary component 72 and on the insertion component 22 can be discerned.

The present invention, in its design, is not restricted to the exemplary embodiments presented above, which are only to be understood as examples. The shape and the embodiment of the secondary flow ducts and of the components constituting them (support component, insertion component and auxiliary component) can for example be designed in a different manner than that shown.

What is claimed is:

1. A structural assembly for a turbofan engine comprising:

a main flow path boundary confining a main flow path of a fluid-flow machine, where at least one row of blades each with one blade end is arranged in the main flow path, where a gap exists between the blade ends of the at least one row of blades and the main flow path boundary, and where there is a rotating relative movement between the blades of a blade row and the main flow path boundary, and at least one secondary flow duct, having in the main flow path boundary, two openings, one opening each at ends spaced apart in a flow direction, such that the at least one secondary flow duct is connected to the main flow path via the two openings, wherein:

the structural assembly has at least one support component and a separate at least one insertion component, the at least one support component includes a structure extending in a circumferential direction and receiving or holding the at least one insertion component along a circumference thereof, the structure extending in the circumferential direction is at least one chosen from a recess, a projection and a ridge, a face of the at least one insertion component forms a first part of the main flow path boundary, and the at least one secondary flow duct is jointly limited along at least part of a course thereof by faces of the at least one support component and the at least one insertion component, a face of the at least one support component forms a second part of the main flow path boundary;

wherein the at least one support component is at least one chosen from an annular casing and a half-shell casing of the turbofan engine and encloses at least one further component of the structural assembly from outside the at least one further component.

2. The assembly in accordance with claim 1, wherein the structural assembly includes at least one auxiliary component with a face limiting the at least one secondary flow duct along at least part of its course.

3. The assembly in accordance with claim 1, wherein at least one auxiliary component is arranged in an axial direction in front of or behind the at least one insertion component and forms together with a further face of the at least one insertion component a section of the at least one secondary flow duct.

4. The assembly in accordance with claim 1, wherein the at least one support component is annular or semi-annular on a hub of the turbofan engine and braces at least one further component of the structural assembly from inside the at least one further component.

5. The assembly in accordance with claim 2, wherein at least one chosen from the at least one insertion component and the at least one auxiliary component of the assembly is a complete ring or a ring sector.

6. The assembly in accordance with claim 1, wherein both the at least one support component and the at least one insertion component are annular casings.

7. The assembly in accordance with claim 1, wherein the at least one secondary flow duct is provided predominantly in the at least one insertion component and a further face of the at least one support component completes the at least one secondary flow duct.

8. The assembly in accordance with claim 7, wherein the further face of the at least one support component completing the at least one secondary flow duct is at least one chosen from part of a plane, a cone, a circular cylinder and a cylinder such that sections of the at least one secondary flow duct in the at least one insertion component that are still open are closed flush.

9. The assembly in accordance with claim 1, wherein the at least one secondary flow duct is provided predominantly in the at least one support component and a further face of the at least one insertion component completes the at least one secondary flow duct.

10. The assembly in accordance with claim 9, wherein the further face of the at least one insertion component completing the at least one secondary flow duct is at least one chosen from part of a plane, a cone, a circular cylinder and a cylinder such that sections of the at least one secondary flow duct in the at least one support component that are still open are closed flush.

11. The assembly in accordance with claim 1, wherein a side of the at least one insertion component facing away from the main flow path is in a meridional view surrounded predominantly by the at least one support component.

12. The assembly in accordance with claim 1, wherein the at least one insertion component includes a shape and surface finish permitting insertion into the at least one support component in an axial direction of the turbofan engine.

13. The assembly in accordance with claim 1, wherein the at least one support component and the at least one insertion component are connected by a common flange.

14. The assembly in accordance with claim 1, wherein wetted surfaces of the at least one secondary flow duct are split between the at least one support component and the at least one insertion component such that a central section of the at least one secondary flow duct, which when seen in a meridional view, runs substantially along a direction of the main flow path boundary, is provided in the at least one support component and is covered by a surface of the at least one insertion component, while at least one section of the at least one secondary flow duct provided in an area of the two openings on the main flow path boundary includes all wetted faces completely inside the at least one insertion component.

15. The assembly in accordance with claim 1, and further comprising a replaceable plug that passes through at least one chosen from the at least one support component and the at least one insertion component from a side facing away from the main flow path, where the replaceable plug contains a section of the at least one secondary flow duct such to connect to a remaining section of the at least one secondary flow duct not extending inside the replaceable plug.

16. The assembly in accordance with claim 15, wherein a top face of the replaceable plug forms part of the main flow path boundary and the top face includes one of the two openings of the at least one secondary flow duct.

17. The assembly in accordance with claim 2, wherein a central section of the at least one secondary flow duct, which when seen in a meridional view runs substantially along a direction of the main flow path boundary, is provided in at least one chosen from the at least one support component and the at least one insertion component, and at least one further section of the at least one secondary flow duct, which is formed by a combination of faces of the at least one insertion component and the at least one auxiliary component, is provided in an area of the two openings on the main flow path boundary.

18. The assembly in accordance with claim 2, wherein the at least one auxiliary component can be pushed in an axial direction together with the at least one insertion component into the at least one support component.

19. The assembly in accordance with claim 1, wherein, when viewing a section of the at least one secondary flow duct in an area of the two openings on the main flow path boundary, one line with continuously convex curvature and one line with continuously concave curvature exist along the inner contour of the at least one secondary flow duct, the lines being substantially opposite each other inside a section of the at least one secondary flow duct.

20. A fluid-flow machine including an assembly in accordance with claim 1.

21. The assembly in accordance with claim 1, wherein the at least one support component and the at least one insertion component form an entirety of the at least one secondary flow duct.

22. A structural assembly for a turbofan engine comprising:

a main flow path boundary confining a main flow path of a fluid-flow machine, where at least one row of blades each with one blade end is arranged in the main flow path, where a gap exists between the blade ends of the at least one row of blades and the main flow path boundary, and where there is a rotating relative movement between the blades of a blade row and the main flow path boundary, and at least one secondary flow duct, having in the main flow path boundary, two openings, one opening each at ends spaced apart in a flow direction, such that the at least one secondary flow duct is connected to the main flow path via the two openings, wherein:

the structural assembly has at least one support component and a separate at least one insertion component, the at least one support component includes a structure extending in a circumferential direction and receiving or holding the at least one insertion component along a circumference thereof, the structure extending in the circumferential direction is at least one chosen from a recess, a projection and a ridge, a face of the at least one insertion component forms a first part of the main flow path boundary, and the at least one secondary flow duct is jointly limited along at least part of a course thereof by faces of the at least one support component and the at least one insertion component, a face of the at least one support component forms a second part of the main flow path boundary;

wherein the at least one secondary flow duct is provided predominantly in the at least one insertion component and a further face of the at least one support component completes the at least one secondary flow duct.

23. The assembly in accordance with claim 22, wherein the further face of the at least one support component completing the at least one secondary flow duct is at least one chosen from part of a plane, a cone, a circular cylinder and a cylinder such that sections of the at least one secondary flow duct in the at least one insertion component that are still open are closed flush.

24. The assembly in accordance with claim 22, and further comprising a replaceable plug that passes through at least one chosen from the at least one support component and the at least one insertion component from a side facing away from the main flow path, where the replaceable plug contains a section of the at least one secondary flow duct such to connect to a remaining section of the at least one secondary flow duct not extending inside the replaceable plug.

25. The assembly in accordance with claim 24, wherein a top face of the replaceable plug forms part of the main flow path boundary and the top face includes one of the two openings of the at least one secondary flow duct.

26. A structural assembly for a turbofan engine comprising:

a main flow path boundary confining a main flow path of a fluid-flow machine, where at least one row of blades each with one blade end is arranged in the main flow path, where a gap exists between the blade ends of the at least one row of blades and the main flow path boundary, and where there is a rotating relative movement between the blades of a blade row and the main flow path boundary, and at least one secondary flow duct, having in the main flow path boundary, two openings, one opening each at ends spaced apart in a flow direction, such that the at least one secondary flow duct is connected to the main flow path via the two openings, wherein:

the structural assembly has at least one support component and a separate at least one insertion component, the at least one support component includes a structure extending in a circumferential direction and receiving or holding the at least one insertion component along a circumference thereof, the structure extending in the circumferential direction is at least one chosen from a recess, a projection and a ridge, a face of the at least one insertion component forms a first part of the main flow path boundary, and the at least one secondary flow duct is jointly limited along at least part of a course thereof by faces of the at least one support component and the at least one insertion component, a face of the at least one support component forms a second part of the main flow path boundary;

wherein the at least one support component and the at least one insertion component are connected by a common flange.

* * * * *